US006438208B1

(12) United States Patent
Koller

(10) Patent No.: US 6,438,208 B1
(45) Date of Patent: Aug. 20, 2002

(54) LARGE SURFACE AREA X-RAY TUBE WINDOW AND WINDOW COOLING PLENUM

(75) Inventor: Thomas J. Koller, Salt Lake City, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 0 days.

(21) Appl. No.: 09/657,502

(22) Filed: Sep. 8, 2000

(51) Int. Cl.[7] ..... G21K 1/00
(52) U.S. Cl. ..... 378/140; 378/161
(58) Field of Search ..... 378/140, 141, 378/161

(56) References Cited

U.S. PATENT DOCUMENTS

| | | | | |
|---|---|---|---|---|
| 2,896,105 A | * | 7/1959 | Hosemann | 378/140 |
| 4,115,697 A | | 9/1978 | Hounsfield et al. | 250/445 T |
| 4,622,687 A | | 11/1986 | Whitaker et al. | 378/130 |
| 4,709,559 A | | 12/1987 | Dotzauer et al. | 62/499 |
| 4,862,490 A | * | 8/1989 | Karneyos et al. | 378/140 |
| 5,018,181 A | | 5/1991 | Iversen et al. | 378/144 |
| 5,541,975 A | | 7/1996 | Anderson et al. | 378/130 |
| 5,689,542 A | | 11/1997 | Lavering et al. | 378/142 |
| 5,737,387 A | | 4/1998 | Smither | 378/130 |
| 6,002,745 A | | 12/1999 | Miller et al. | 378/128 |
| 6,074,092 A | | 6/2000 | Andrews | 378/200 |
| 6,115,454 A | | 9/2000 | Andrews et al. | 378/140 |
| 6,125,169 A | | 9/2000 | Wandke et al. | 378/143 |

* cited by examiner

*Primary Examiner*—Craig E. Church
(74) *Attorney, Agent, or Firm*—Workman, Nydegger & Seeley

(57) ABSTRACT

A window and cooling plenum for use with x-ray devices. The x-ray device includes an x-ray tube at least partially immersed in coolant contained within a reservoir. The coolant is continuously circulated through the reservoir by an external cooling unit. The window is brazed into a vacuum enclosure of the x-ray tube and includes a plurality of extended surfaces that are integral with the window. A compensating window is also provided and is disposed substantially proximate to the extended surfaces of the window so that a fluid passageway is defined. The compensating window and window are substantially enclosed within a cooling plenum having fluid inlet and outlet connections in fluid communication with the fluid passageway and the reservoir. A flow of coolant generated by the external cooling unit enters the fluid passageway so that the coolant is able to absorb heat dissipated by the window. Upon exiting the fluid passageway, the coolant returns to the reservoir to repeat the cycle. In addition to facilitating definition of the fluid passageway, the compensating window includes extended surfaces and slots which serve to attenuate differences in the intensity of x-rays emitted through the extended surfaces and slots of the window. By ensuring that the x-rays ultimately emitted from the x-ray device are of substantially uniform intensity, the compensating window serves to maintain the quality of diagnostic images produced by the x-ray device.

51 Claims, 7 Drawing Sheets

LARGE SURFACE AREA X-RAY TUBE WINDOW AND WINDOW COOLING PLENUM

BACKGROUND OF THE INVENTION

The present invention relates generally to x-ray tubes. More particularly, embodiments of the present invention relate to an x-ray tube cooling system that increases the rate of heat transfer from the x-ray tube to a cooling system medium so as to significantly reduce heat-induced stress and strain in the x-ray tube structures and thereby extend the operating life of the device

THE PRIOR STATE OF THE ART

X-ray producing devices are extremely valuable tools that are used in a wide variety of applications, both industrial and medical. For example, such equipment is commonly used in areas such as diagnostic and therapeutic radiology; semiconductor manufacture and fabrication; and materials analysis and testing. While used in a number of different applications, the basic operation of x-ray tubes is similar. In general, x-rays, or x-ray radiation, are produced when electrons are produced, accelerated, and then impinged upon a material of a particular composition.

Typically, this process is carried out within an evacuated enclosure, or "can." Disposed within the can is an electron generator, or cathode, and a target anode, which is spaced apart from the cathode. In operation, electrical power is applied to a filament portion of the cathode, which causes electrons to be emitted. A high voltage potential is then placed between the anode and the cathode, which causes the emitted electrons accelerate towards a target surface positioned on the anode. Typically, the electrons are "focused" into a primary electron beam towards a desired "focal spot" located at the target surface. In addition, some x-ray tubes employ a deflector device to control the direction of the primary electron beam. For example, a deflector device can be a magnetic coil disposed around an aperture that is disposed between the cathode and the target anode. The magnetic coil is used to produce a magnetic field that alters the direction of the primary electron beam. The magnetic force can thus be used to manipulate the direction of the beam, and thereby adjust the position of the focal spot on the anode target surface. A deflection device can be used to control the size and/or shape of the focal spot.

During operation of an x-ray tube, the electrons in the primary electron beam strike the target anode surface (or focal track) at a high velocity. The target surface on the target anode is composed of a material having a high atomic number, and a portion of the kinetic energy of the striking electron stream is thus converted to electromagnetic waves of very high frequency, i.e., x-rays. The resulting x-rays emanate from the target surface, and are then collimated through a window formed in the x-ray tube for penetration into an object, such as a patient's body. As is well known, the x-rays can be used for therapeutic treatment, or for x-ray medical diagnostic examination or material analysis procedures.

A percentage of the electrons that strike the target anode target surface rebound from the surface and then either impact at other random areas on the target surface, or at other "non-target" surfaces within the x-ray tube can. The electrons within this secondary electron beam are often referred to as "secondary" electrons. These secondary electrons retain a significant amount of kinetic energy after rebounding, and when they impact these other non-target surfaces, a significant amount of heat is generated. In fact, as many as half the electrons generated by the cathode, representing as much as one third of the total energy of the electron beam, rebound from the target as secondary electrons. As discussed in further detail below, the heat thus generated can ultimately damage the x-ray tube, and shorten its operational life.

In particular, the temperatures generated by secondary electrons, in conjunction with the high temperatures generated by the primary electrons at the focal spot of the target surface, often reach levels high enough to damage portions of the x-ray tube structure. The window of the x-ray tube, and the joints and connection points between x-ray tube structures, are examples of areas where the x-ray tube can be weakened when repeatedly subjected to such thermal stresses. In some instances, the resulting temperatures can even melt portions of the x-ray tube, such as lead shielding disposed on the can. Such conditions can shorten the operating life of the tube, affect its operating efficiency, and/or render it inoperable.

Further, because the trajectories of secondary electrons cause them to impact some interior surface locations with relatively greater frequency than other areas, the resulting heat distribution can be uneven. The varying rates of thermal expansion cause mechanical stresses and strains when the cooler part of the structure resists the expansion of the hotter portion of the structure. Ultimately, this can cause a mechanical failure in the part, especially over numerous operating cycles.

While the aforementioned problems are cause for concern in all x-ray tubes, these problems become particularly acute in the new generation of high-power x-ray tubes (generally, those x-ray tubes with operating powers exceeding 20 kilowatts (kw)) which have relatively higher operating temperatures than the typical devices.

Note that the problems herein described are also cause for concern where long exposures, or exposure chains, are being performed, regardless of the power of the x-ray tube performing the exposures. Some examples of these types of exposures include helical computed tomography scanning, and angiography.

Attempts have been made to reduce temperatures in such areas of high heat concentration, and to minimize thermal stress and strain, through the use of various types of cooling systems. However, previously available x-ray tube cooling systems have not been entirely satisfactory in providing effective and efficient cooling, and have been especially ineffectual in those particular regions of the tube that are subjected to high temperatures, such as from rebounding electrons. Moreover, the inadequacies of known x-ray tube cooling systems are further exacerbated by the increased heat levels that are characteristic in high-powered x-ray tubes.

For example, conventional x-ray tube systems often utilize some type of liquid cooling arrangement. In such systems, at least some of the external surfaces of the vacuum enclosure are placed in contact with a circulating coolant, which facilitates a convective cooling process. While these types of processes are adequate to cool some portions of the x-ray tube, they may not adequately cool areas of localized heat—such as those that are particularly susceptible to heating from secondary electrons, including the window area of the tube, the window itself, and portions of the can structure that are proximate to the window area. The joint where the x-ray tube window is attached to the can is also particularly vulnerable to thermally induced damage, due largely to the relatively close proximity of this joint to the cathode and anode, and may not be adequately cooled by conventional cooling systems and processes.

Not only does its close proximity to the cathode and anode render the window especially susceptible to thermally induced damage, but certain characteristics of the window itself also make the window vulnerable to such damage. For example, because the window is relatively thin and is typically constructed of a material having a low atomic number, such as beryllium, it is relatively more susceptible to heat damage.

As suggested above, the window area of the x-ray tube, and the window itself, are particularly susceptible to heat induced structural damage, due at least in part to their proximity to the target anode, and the cathode. The damage caused by high temperatures is not limited solely to destructive structural effects however. For example, even in relatively low-powered x-ray tubes, the window area can become sufficiently hot to boil coolant that is adjacent to the window. Heat levels such as this can induce potentially destructive mechanical stresses in the window and the joint between the window and the can. A related, and undesirable, consequence is that the bubbles produced by boiling of the coolant may obscure the window of the x-ray tube and thereby compromise the quality of the images produced by the x-ray device. Further, boiling of the coolant can result in the chemical breakdown of the coolant, thereby rendering it ineffective, and necessitating its removal and replacement.

In view of the foregoing problems and shortcomings with existing x-ray tube cooling systems, it would be an advancement in the art to provide a cooling system that removes heat from the x-ray tube, and that effectively removes heat from specific regions of the tube, such as the window and structural portions of the can adjacent to the window. Further, the cooling system should effect sufficient heat removal so as to reduce the amount of thermally-induced mechanical stresses otherwise present within the x-ray tube, and thereby increase the overall operating life of the x-ray tube. Likewise, the cooling system should substantially prevent heat-related damage from occurring in the materials used to fabricate the vacuum enclosure, and should reduce structural damage occurring at joints between the various structural components of the x-ray tube.

SUMMARY AND OBJECTS OF THE INVENTION

The present invention has been developed in response to the current state of the art, and in particular, in response to these and other problems and needs that have not been fully or adequately solved by currently available x-ray tube cooling systems. Thus, it is an overall object of embodiments of the present invention to provide a cooling system that effectively and efficiently removes excessive heat from x-ray tube components.

It is also an object to provide a cooling system that will efficiently and effectively remove heat from specific regions of the x-ray tube that are routinely exposed to particularly high temperatures. Similarly, it is an objective to remove heat at a higher rate from these specific regions—as opposed to other relatively cooler regions—so as to maintain a substantially uniform thermal state as between the various x-ray tube regions and avoid destructive thermal expansion discrepancies.

Another related objective is to remove sufficient heat from the x-ray tube as to reduce the occurrence of thermally induced stresses that could otherwise reduce the tube's operating efficiency, limit its operating life, and/or render the tube inoperable.

In summary, these and other objects, advantages, and features are achieved with an improved cooling system for use in effecting heat transfer from any x-ray tube. Embodiments of the present invention are particularly suitable for use with high-powered x-ray tubes.

In a preferred embodiment, the cooling system includes a reservoir filled with coolant in which an vacuum enclosure of the x-ray tube is at least partially immersed. A window of the x-ray device is mounted in the vacuum enclosure. Preferably the evacuated enclosure is made of copper and the window is made of beryllium. The window includes a body having attached thereto a plurality of extended surfaces. The extended surfaces are preferably integrally formed with the body of the window. In a preferred embodiment, the extended surfaces comprise fins disposed in a plane substantially parallel to that of a computerized tomography ("CT") slice produced by the x-ray device. Preferably, the cooling system also includes a compensating window having a plurality of extended surfaces and slots disposed substantially proximate to the slots and extended surfaces, respectively, of the window so as to cooperate therewith to define a fluid passageway, and the whole is enclosed within a cooling plenum having fluid inlet and outlet connections in fluid communication with the fluid passageway and the reservoir. A flow of coolant is produced by an external cooling unit.

In operation, the x-ray device produces x-rays which are directed through the window and pass into, for example, the body of a patient. Due to the high operating temperatures of the x-ray device, the window and adjacent vacuum enclosure structure become extremely hot. Accordingly, the external cooling unit directs a flow of coolant through the fluid passageway cooperatively defined by the compensating window and the extended surfaces of the window, so that the coolant absorbs at least some of the heat dissipated by the window and adjacent vacuum enclosure structure. Because the extended surfaces formed in the window increase the surface area of the window, and are in direct contact with the liquid coolant, they serve to facilitate a higher rate of heat transfer from the window, and from the surrounding vacuum enclosure structure, than would otherwise be possible. Finally, the extended surfaces and slot of the compensating window, in addition to facilitating definition of the fluid passageway, also serve to selectively attenuate the intensity of x-rays emitted through the window so as to ensure that the intensity of x-rays ultimately emitted into the x-ray subject from the compensating window is substantially uniform. The extended surfaces and slots of the compensating window thereby help to maintain the quality of the diagnostic images produced by the x-ray device.

These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and features of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF VARIOUS EMBODIMENTS

Reference will now be made to figures wherein like structures will be provided with like reference designations. It is to be understood that the drawings are diagrammatic and schematic representations of various embodiments of the invention, and are not to be construed as limiting the present invention, nor are the drawings necessarily drawn to scale.

In general, the present invention relates to cooling systems for use in any type of x-ray tube environment requiring improved cooling. FIGS. 1 through 7 indicate various embodiments of a cooling system conforming to the teachings of the invention.

Figure 1:
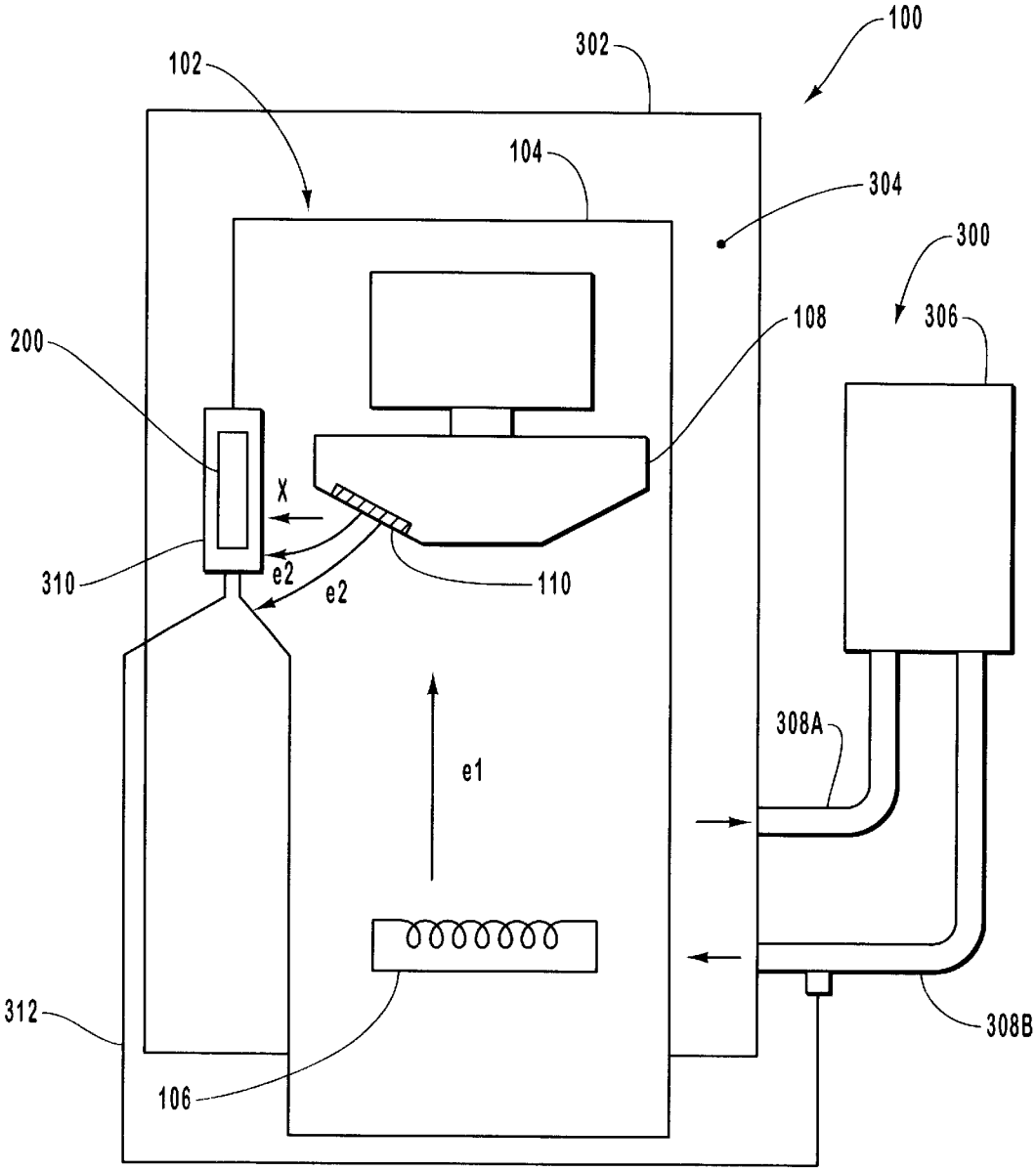
FIG. 1 is a cutaway view of an x-ray device, depicting some of the fundamental elements of an x-ray tube, typical travel paths of secondary electrons, and elements of an x-ray tube cooling system.

Reference is first made to FIG. 1, which depicts an x-ray device indicated generally at 100. X-ray device 100 includes an x-ray tube 102 having a vacuum enclosure 104, inside of which are disposed an electron source 106 and a target anode 108. In operation, power is applied to electron source 106, which causes a beam of electrons e1 to be emitted by thermionic emission. A potential difference is applied between the electron source 106 and target anode 108, which causes the electrons e1 to accelerate, and then impinge upon a focal spot 110 location on the target anode 108. A portion of the resulting kinetic energy is released as x-rays, indicated at "X", which are then collimated and emitted through window 200 and into, for example, the body of a patient.

As is represented in FIG. 1, some of the electrons strike and then rebound from the surface of target anode 106, and then strike other "non-target" areas, such as the window 200, and/or other areas within vacuum enclosure 104. As discussed elsewhere, the kinetic energy of these secondary electron e2 collisions generates extremely high temperatures. Moreover, since a relatively large number of the rebounding electrons strike the window 110 and the adjacent structure of the vacuum enclosure 104, a significant amount of heat is created in those areas. This heat must be reliably and continuously removed.

With continuing reference to FIG. 1, x-ray tube 100 also includes a cooling system 300 having a reservoir 302 containing a volume of liquid coolant 304 in which x-ray tube 102 is at least partially immersed. In a preferred embodiment, liquid coolant 304 is a dielectric oil, but can be any appropriate fluid that is capable of functioning as a heat transfer medium. One such fluid is Syltherm.

An external cooling unit 306 is connected to reservoir 302 by way of fluid conduits 308A and 308B, as shown in FIG. 1. In a preferred embodiment, external cooling unit 306 comprises a fluid pump, as well as a heat exchanger, or the like, that is configured to remove heat from liquid coolant 304. Fluid conduits 308A and 308B preferably comprise hoses or the like.

In general, liquid coolant 304 circulates through reservoir 302 and absorbs at least some of the heat generated by x-ray tube 102, including heat present in window 200 and the adjacent vacuum enclosure 104 structure. Liquid coolant 304 then exits reservoir 302 via fluid conduit 308A and enters external cooling unit 306 where at least some heat is removed from liquid coolant 304. Thus cooled, liquid coolant 304 then re-enters reservoir 302 by way of fluid conduit 308B to repeat the cycle. As discussed in further detail below, a portion of the liquid coolant 304 exiting external cooling unit 306 is preferably diverted to a cooling plenum 310 substantially enclosing window 200, so as to provide for a relative increase in the rate at which heat is removed from window 200 and the adjacent structure of vacuum enclosure 104. A fluid conduit 312 connects external cooling unit 110 and cooling plenum 310.

Figure 2:
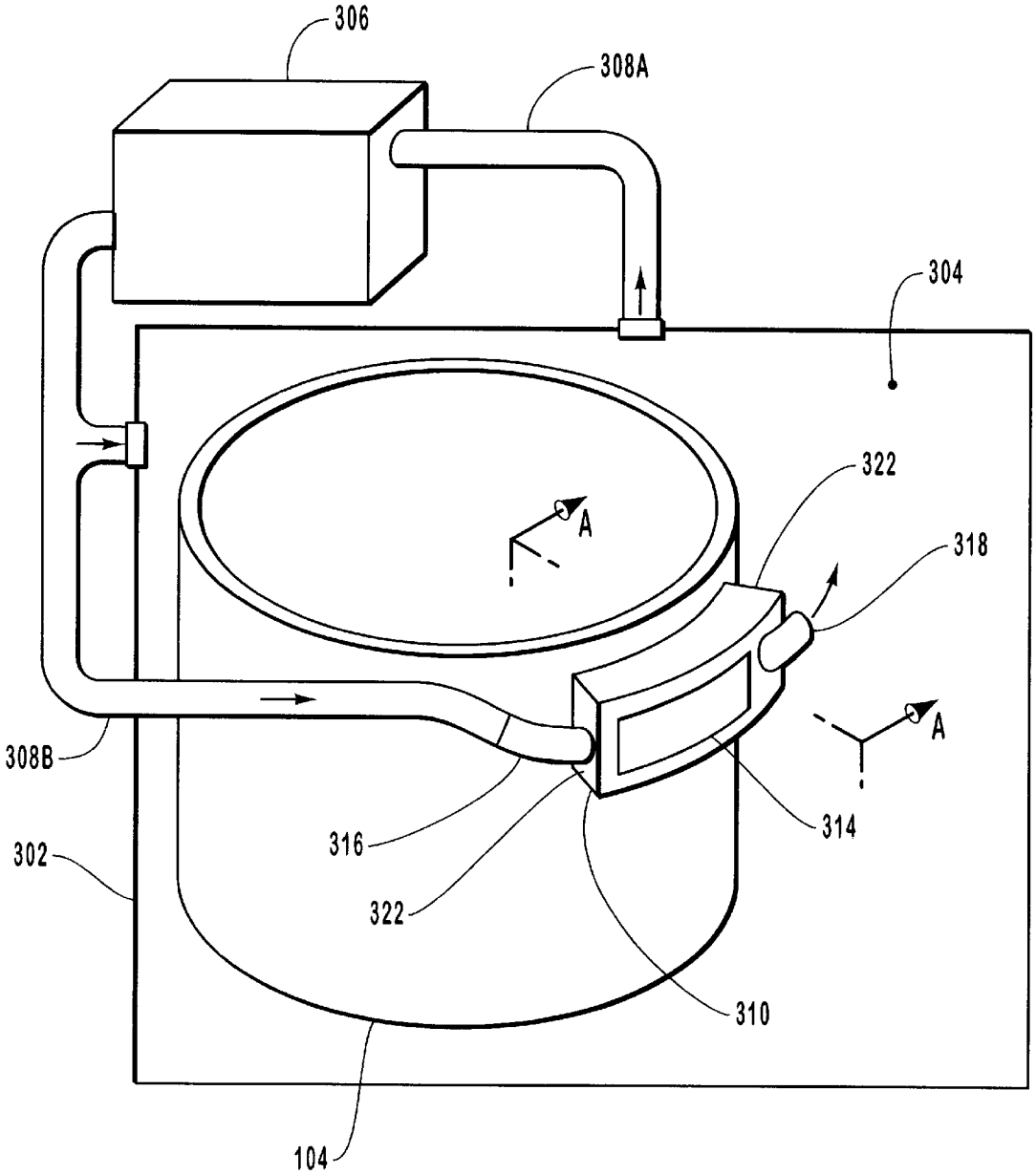
FIG. 2 is a perspective view of a vacuum enclosure, and indicating embodiments of a cooling plenum and a compensating window.

Turning now to FIG. 2, additional details regarding the construction and operation of cooling plenum 310, and window 200, are provided. Cooling plenum 310 is preferably integral with vacuum enclosure 104. Alternatively however, cooling plenum 310 may be formed separately from vacuum enclosure 104 and attached thereto by a joining process such as welding, brazing, or the like. Cooling plenum 310 preferably includes a compensating window 314. In a preferred embodiment, cooling plenum 310 is made of copper. However, any other cooling plenum material providing the functionality of copper, as disclosed herein, is contemplated as being within the scope of the present invention.

Figure 3A:
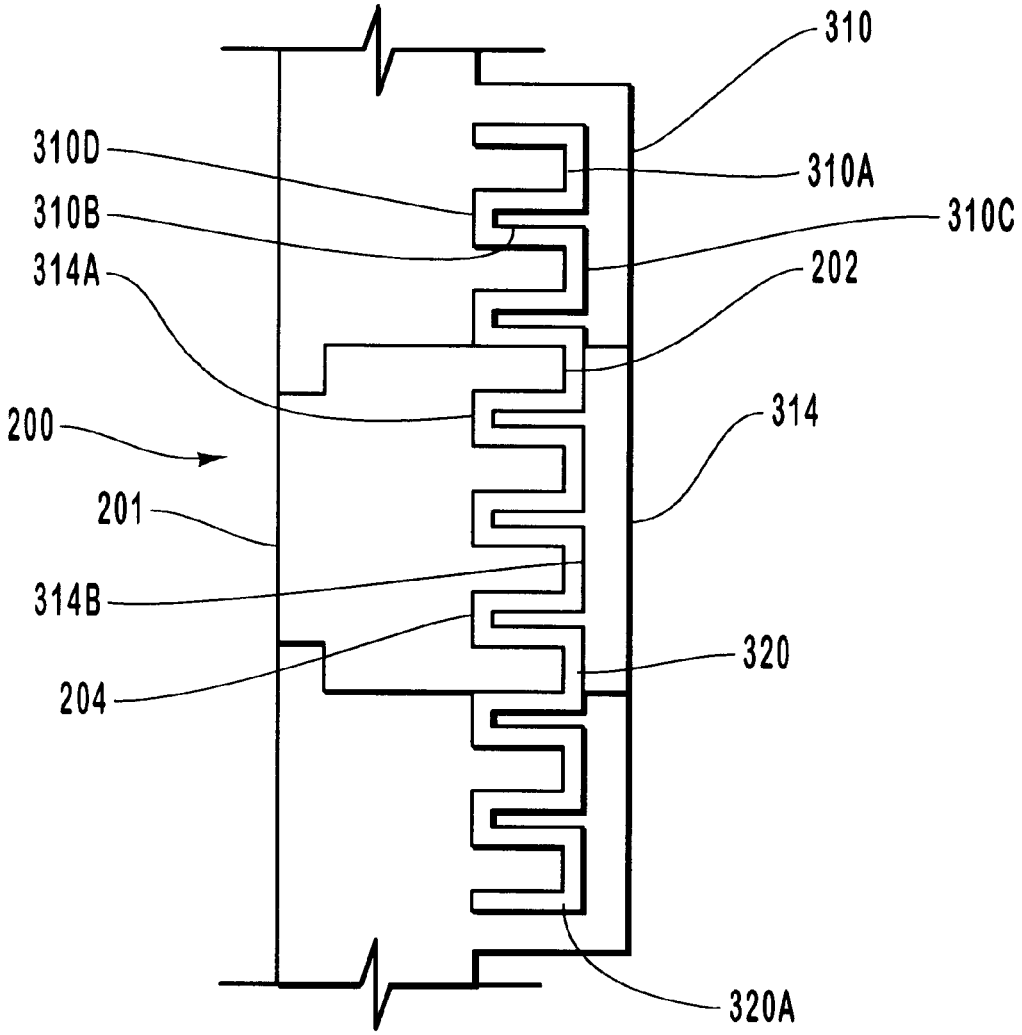
FIGS. 3A through 3C are section views taken along line A—A of FIG. 2, indicating various arrangements of a cooling plenum, window, and compensating window.

With reference now to FIG. 3A, and with continuing reference to FIG. 2, cooling plenum 310 further comprises a fluid inlet connection 316 and a fluid outlet connection 318, both of which are in fluid communication with a fluid passageway 320 which is cooperatively defined by cooling plenum 310, compensating window 314, and window 200.

As further suggested in FIG. 3A, an important feature of x-ray tube cooling system 300 relates to the construction of window 200. In particular, window 200 comprises a body 201 having a plurality of extended surfaces 202 attached thereto. As a consequence of the disposition of extended surfaces 202 on body 201 of window 200, a plurality of slots 204 are necessarily defined, a slot 204 being interposed between succeeding extended surfaces 202, as indicated in FIG. 3A. Extended surfaces 202 are preferably integrally formed with body 201 and are in substantial contact with liquid coolant 304 as liquid coolant 304 flows through fluid passageway 320.

While extended surfaces 202 are preferably integral with body 201 of window 200, it will be appreciated that extended surfaces 202 could be separately formed, either individually or collectively, and then attached to body 201 so as to provide the functionality disclosed herein. In a preferred embodiment, extended surfaces 202 comprise fins, or the like. However, it will be appreciated that a wide variety of extended surface types, and/or combinations thereof, could be employed to provide the functionality disclosed herein. To the extent such extended surface types conform to the requirements outlined elsewhere herein for extended surfaces 202, they are contemplated as being within the scope of the present invention. Such other extended surface types include, but are not limited to, rectangular protrusions, pyramidal protrusions, cylindrical protrusions, and the like.

In general, extended surfaces 202 serve to increase the overall surface area of window 200. As is well known, the rate of heat transfer from a body is directly proportional to the surface area of that body that is in contact with the cooling medium. Accordingly, extended surfaces 202 serve to facilitate a relative increase in the rate at which heat dissipated by window 200 is absorbed by the liquid coolant 304 as liquid coolant 304 flows through fluid passageway 320. Because extended surfaces 202 permit window 200 to dissipate heat at a relatively higher rate than otherwise possible, the functionality of x-ray device 100 is significantly improved. That is, the higher rate of heat dissipation from window 200 allows x-ray device 100 to operate at relatively higher power levels and/or for relatively longer periods of time, such as are required for helical exposures or other similar evolutions.

As previously noted, compensating window 314 is preferably disposed in relatively close proximity to window 200 so as to cooperate with window 200 to define a fluid passageway 320 having a cross-section with a relatively small perimeter, indicated in FIG. 3A. In particular, compensating window 314 includes extended surfaces 314A and slots 314B which are disposed opposite slots 204 and extended surfaces 202, respectively, of window 200. As compensating window 314 and window 200 are brought together, their respective extended surfaces and slots cooperate with each other to define fluid passageway 320. Note that, in addition to facilitating cooling of window 200, compensating window 314 possesses other valuable features, at least some of which relate to x-ray intensity attenuation, discussed in detail elsewhere herein.

In similar fashion to that just described, cooling plenum 310 preferably comprises extended surfaces 310A and 310B that cooperate with, respectively, slots 310C and 310D, to form a fluid passageway 320A in communication with fluid passageway 320. It will be appreciated that various other configurations could be profitably employed as well. Such other configurations include, but are not limited to, one where only fluid passageway 320 is defined. Generally however, any configuration providing the functionality disclosed herein is contemplated as being within the scope of the present invention.

Directing further attention now to fluid passageway 320, it is well known that, for a given flow rate, the velocity of a fluid through a passageway increases as the cross-section area of that passageway decreases. It is also well known that the rate of heat absorption by a flowing coolant is directly proportional to the velocity of the coolant so that relatively higher velocities produce relatively higher rates of heat absorption by the coolant. Thus, a fluid passageway 320 with a relatively small cross-sectional area translates to an increased rate of heat absorption by liquid coolant 304, for a given flow rate of liquid coolant 304. It will be appreciated that the distance between compensating window 314 and window 200 may thus be varied so as to achieve a desired cooling effect. Likewise, the flow rate of liquid coolant 304 may be varied to the same end.

The forced convective heat transfer thus facilitated by the flow of liquid coolant 304 through fluid passageway 320 desirably augments the convective heat transfer effect achieved by virtue of the contact between exterior surfaces 322 (see FIG. 2) of cooling plenum 310 and liquid coolant 304 so as to enable a relatively higher rate of heat transfer from window 200 and from the adjacent vacuum enclosure 104 structure than would otherwise be possible. As a result of the relatively higher rate of heat transfer from these areas, the functionality of x-ray device 100 is greatly enhanced. In particular, x-ray device 100 is able to operate at relatively higher temperatures and/or for relatively longer periods of time without compromising the operational or structural integrity of window 200 and/or that of adjacent vacuum enclosure 104 structure.

Figure 3B:
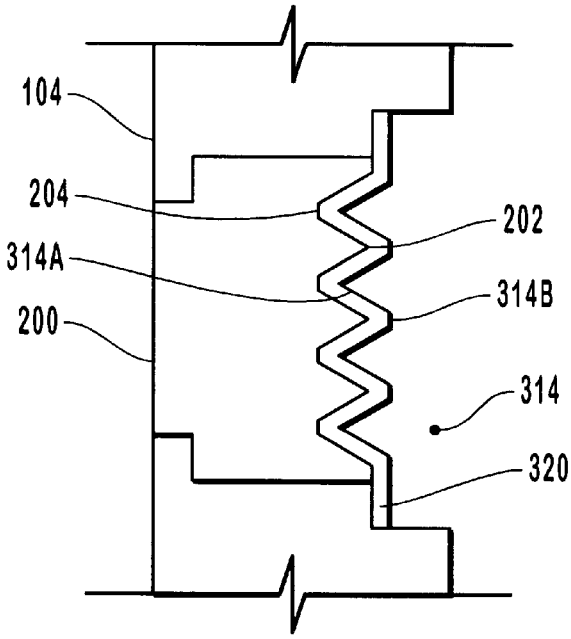
Figure 3C:
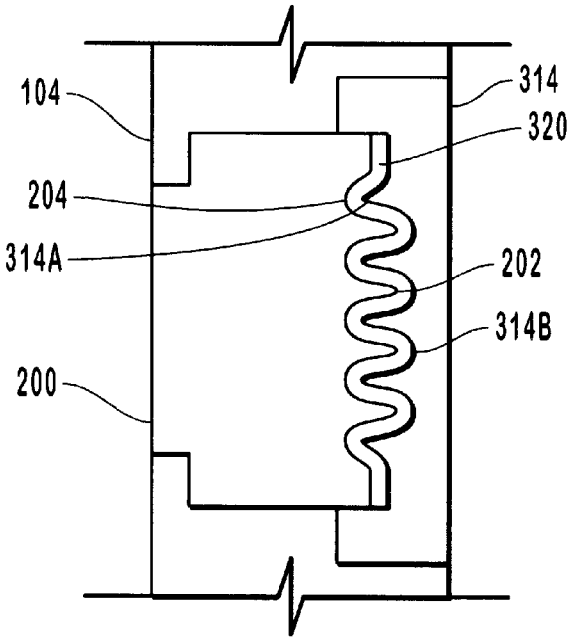

In view of the foregoing discussion, it will be appreciated that the affects achieved by the various extended surfaces and slots indicated in FIG. 3A can be readily obtained with a variety of other geometries as well. Two examples of such alternative geometries are indicated in FIGS. 3B and 3C. With reference first to FIG. 3B, extended surfaces 202 and 314A are generally triangular in cross section, and, in similar fashion, slots 314B and 204 have an analogous shape designed to cooperate with extended surfaces 202 and 314A, respectively, so as to define fluid passageway 320. It will be appreciated that similar configurations could be effectively employed for extended surfaces 310A and 310B and slots 310C and 310D of cooling plenum 310 (see FIG. 3A).

Finally with reference to FIG. 3C, yet another alternative geometry is indicated. In particular, extended surfaces 202 and 314A have a continuous wave shaped cross section, and, in similar fashion, slots 314B and 204 have an analogous shape designed to cooperate with extended surfaces 202 and 314A so as to define fluid passageway 320. As with the embodiment depicted in FIG. 3B, it will be appreciated that similar configurations could be effectively employed for extended surfaces 310A and 310B and slots 310C and 310D of cooling plenum 310 (see FIG. 3A).

In an alternative embodiment of cooling system 300, no cooling plenum or compensating window is employed. Rather, convective cooling of window 200 is facilitated by virtue of the direct contact between extended surfaces 202 and slots 204 of window 200, and liquid coolant 304 disposed in reservoir 302. This embodiment may, or may not, employ an external cooling unit 306.

In the aforementioned embodiment, a pump or the like may additionally be employed so as to enhance the circulation of liquid coolant 304 within reservoir 302. The fluid motion induced by the pump produces a forced convection cooling effect. As liquid coolant 304 flows over extended surfaces 202, it absorbs at least some of the heat dissipated by window 200 and adjacent vacuum enclosure 104 structure. Preferably, the flow produced by the pump is directed primarily over extended surfaces 202 and slots 204. Because the rate of heat transfer is directly proportional to the velocity of liquid coolant 304, the motion imposed by the pump induces a forced convection cooling effect that augments the convective cooling effect realized as a result of the direct contact between extended surfaces 202 and slots 204, and liquid coolant 304 disposed in reservoir 302.

Figure 4:
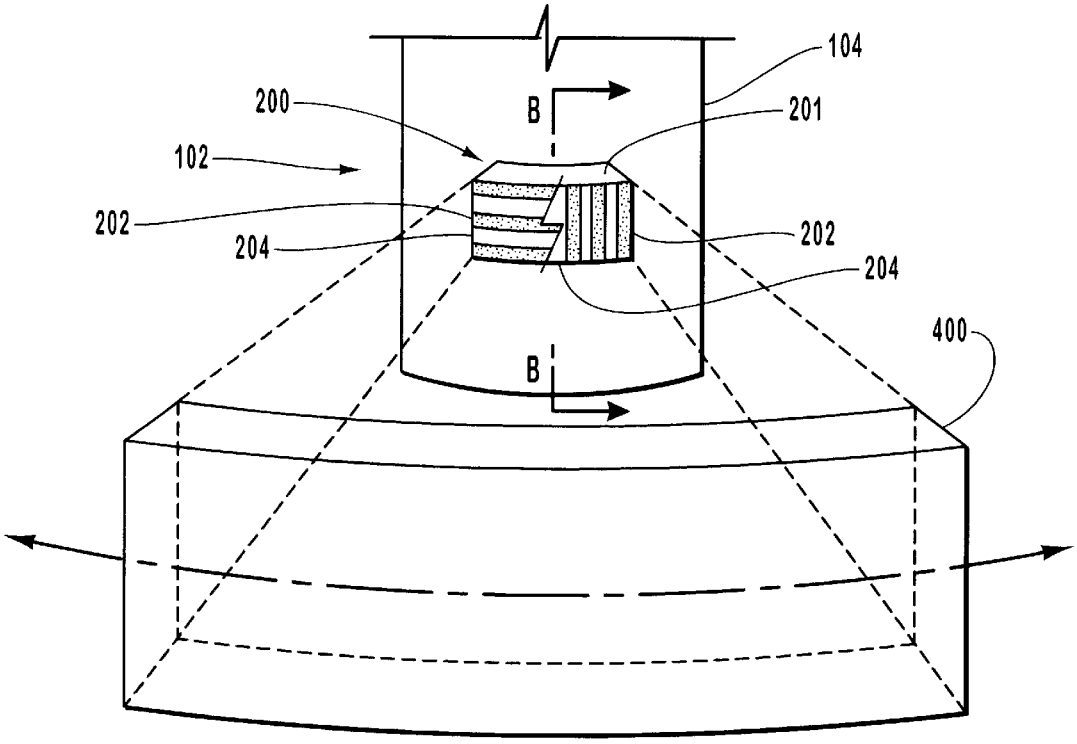
FIG. 4 is a side view of a vacuum enclosure, depicting one embodiment of a window and the relationship of extended surfaces of the window with respect to a CT slice produced by the x-ray device.

Directing attention now to FIG. 4, additional details regarding the construction and operation of window 200 are indicated. In a preferred embodiment, window 200 comprises beryllium. However, it will be appreciated that various other materials may be selected for window 200 so as to produce a desired effect with respect to the cooling of window 200, and/or with respect to the x-rays produced by x-ray device 100. Such other window materials include, but are not limited to, titanium, nickel, carbon, silicon, and aluminum. Window 200 is brazed to vacuum enclosure 104, which is preferably made of copper. Note however, that this invention contemplates as within its scope any other joining method that would provide the functionality if the brazed joint disclosed herein. Such joining methods include, but are not limited to, welding processes and the like.

As noted elsewhere, a plurality of extended surfaces 202 are disposed on body 201 of window 200. Because the intensity of x-rays passing through window 200 is at least partially a function of the window geometry and window material, extended surfaces 202 must be arranged so that they do not materially interfere with the diagnostic imaging quality of x-ray device 100.

In particular, extended surfaces 202 are preferably disposed in a plane which is oriented so as to be substantially parallel to the plane of a CT slice 400. When thus oriented, extended surfaces 202 serve to desirably increase the heat transfer area of window 200 without compromising the diagnostic imaging quality of x-ray device 100. In the embodiment of window 200 disclosed in FIG. 4, extended surfaces 202 are not only disposed in a plane parallel to CT slice 400, but may themselves be parallel to CT slice 400. However, as further suggested by FIG. 4, extended surfaces perpendicular to CT slice 400, but nevertheless disposed in a plane parallel to CT slice 400, would be equally effective in providing the functionality disclosed herein. Accordingly, various orientations of extended surfaces 202 are contemplated as being within the scope of the present invention, at least to the extent that those extended surfaces are disposed within a plane parallel to CT slice 400.

Figure 5A:
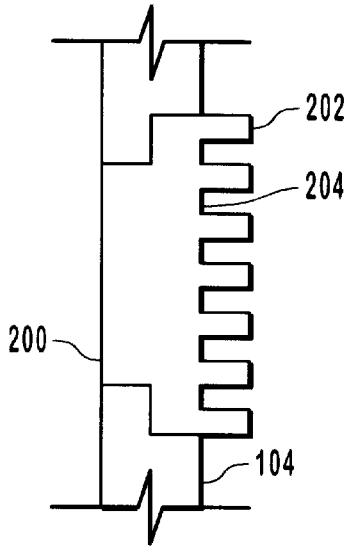
FIGS. 5A through 5D are partial section views taken along line B—B of FIG. 4, indicating the physical arrangement of the vacuum enclosure with respect to embodiments of windows employing various extended surface configurations.

Directing attention now to FIGS. 5A through 5D, various embodiments of a window 200 employing different arrangements of extended surfaces 202 and slots 204, are depicted. Note that the embodiments depicted are representative only and are not intended to limit in any way the scope of the present invention. With reference first to FIG. 5A, one embodiment of window 200 comprises a plurality of extended surfaces 202 and slots 204 distributed substantially uniformly across window 200.

Figure 5C:
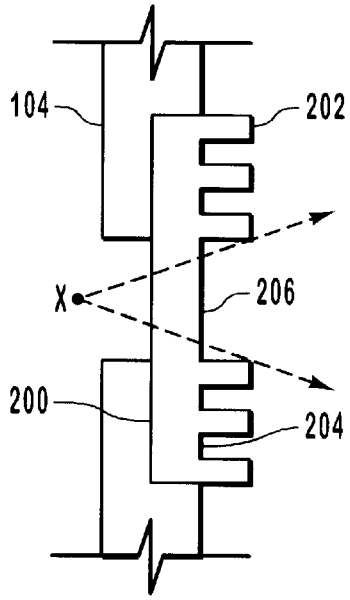
Figure 5B:
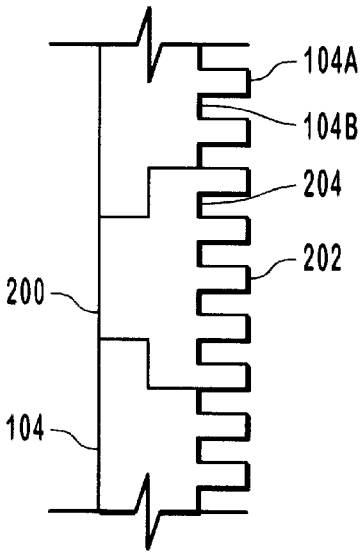

Alternatively, an arrangement is contemplated where a window 200 having a plurality of extended surfaces 202 and slots 204 is joined to a vacuum enclosure 104 having a plurality of extended surfaces 104A and slots 104B, as indicated in FIG. 5B. In this arrangement, extended surfaces 104A and slots 104B of vacuum enclosure 104 serve to increase the surface area of vacuum enclosure 104 in the vicinity of window 200. By increasing the surface area of vacuum enclosure 104, and thus the rate at which heat can be dissipated by vacuum enclosure 104 to liquid coolant 304, extended surfaces 104A and slots 104B serve to desirably augment the cooling effects imparted to window 200 and the adjacent structure by extended surfaces 202 and slots 204.

As indicated in FIG. 5C, it is not necessary that extended surfaces 202 and slots 204 be disposed over the entire surface of window 200 in order to achieve the functionality disclosed herein. In particular, one embodiment of window 200 has a substantially clear area 206 through which a useful beam portion, indicated at "X", of the x-rays produced by x-ray device 100 passes. Where such a configuration is desired, various desired cooling effects may nevertheless be achieved by disposing extended surfaces 202 and slots 204 outside of clear area 206, for example, on the sides of clear area 206 of window 200.

Figure 5D:
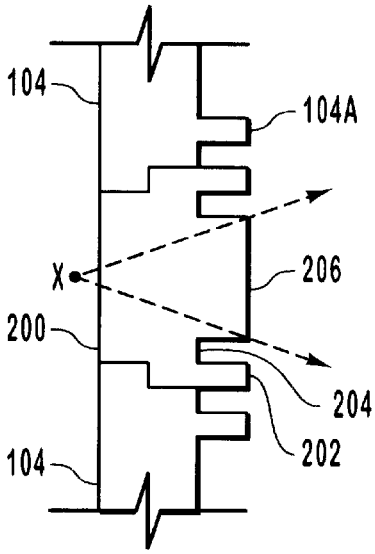

Finally, FIG. 5D indicates an alternative embodiment of a window 200 having a clear area 206 for passage of useful beam portion "X" of x-rays emitted by x-ray device 100. In particular, clear area 206 is embodied as a large extended surface, in contrast to the embodiment depicted in FIG. 5C, where clear area 206 takes the form of a recessed surface.

As discussed above, extended surfaces 202 may be disposed in a wide variety of arrangements, but in any event are preferably disposed in a plane which is substantially parallel to the plane of CT slice 400. Another consideration with regard to the various possible configurations of extended surfaces 202 and slots 204 concerns the tendency of at least some configurations to induce local variations in the intensity of x-rays emitted through window 200.

In particular, a window configured in a manner such that x-ray intensity varies at different locations on the window is undesirable because it may compromise the quality of the image produced by the x-ray device. Accordingly, extended surfaces 202 and slots 204 are preferably configured in such a way as to substantially foreclose material differences between the intensity of x-rays emitted through extended surfaces 202, and the intensity of x-rays emitted through slots 204. That is, the intensity of x-rays emitted through window 200 is preferably uniform over the entire window, without regard to the particular geometry of window 200 at any given point. Uniformity of the x-ray intensity produced by x-ray device 100, and emitted through window 200, can be achieved in a variety of different ways. Some of the various possible approaches are discussed in detail below.

Figure 6:
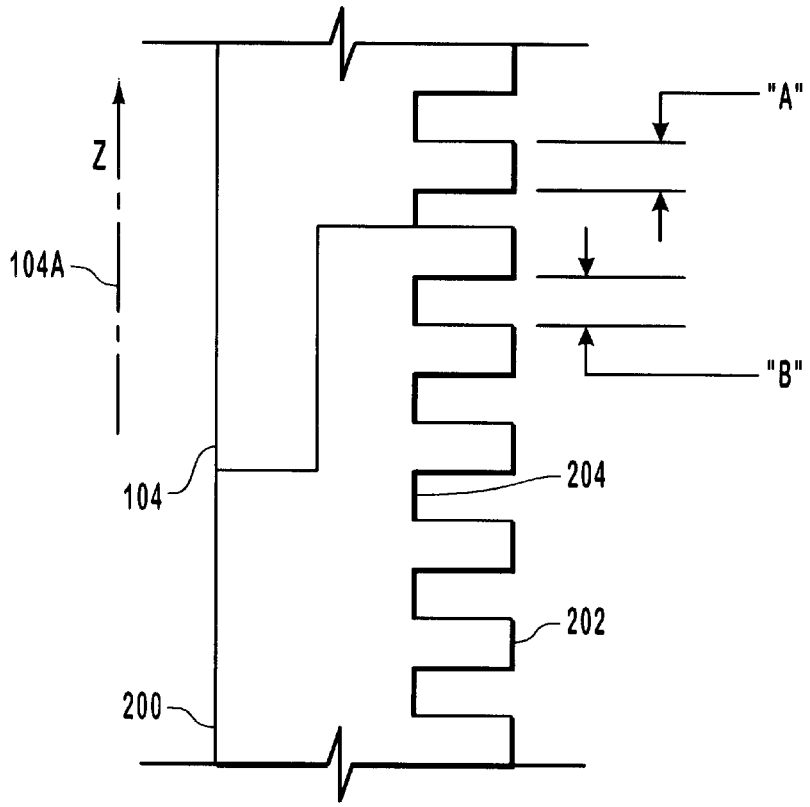
FIG. 6 is a partial section view taken along line B—B of FIG. 4, indicating various dimensional attributes of extended surfaces associated with an embodiment of a window.

One approach to ensuring uniform x-ray intensity through window 200 relates to the specific geometry and dimensions of extended surfaces 202 and slots 204, and is suggested in FIG. 6. In particular, the thickness of extended surfaces 202, indicated as dimension "A", and/or the width of slots 204, indicated as dimension "B", can be varied so as to produce configurations that will ensure uniform intensity of x-rays emitted through window 200.

For example, if x-ray device 100 has a minimum resolving power of 2.0 millimeters (mm) in the "z" direction, indicated by longitudinal axis 104A of vacuum enclosure 104, then dimensions "A" and "B" are preferably made smaller than 0.5 mm, e.g., 0.4 mm. Applying the appropriate formula, i.e., summing dimensions "A" and "B" for two extended surfaces 202 and two slots 204, an overall dimension of 1.6 mm is obtained (2 extended surfaces×0.4 mm, and 2 slots×0.4 mm=an overall dimension of 4×0.4 mm or 1.6 mm). Because 1.6 mm is less than the aforementioned hypothetical minimum resolving power of 2.0 mm, no material variation in x-ray intensity is imposed by extended surfaces 202 and slots 204 of the aforementioned dimensions. Note that dimension "A" need not be the same as dimension "B" in order to achieve the functionality disclosed herein. As one example, dimension "A" could be 0.6 mm and dimension "B" could be 0.2 mm, for an overall dimension of 2×0.6+2×0.2=1.6 mm.

Alternatively, dimensions "A" and "B" may be made greater than the resolving power of x-ray device 100. For example, dimensions "A" and "B" could be made 3 mm each. As with the previous example, dimensions "A" and "B" need not be equal to each other.

Finally, dimensions "A" and "B" may desirably be varied so as to accommodate motion of focal spot 110 (see FIG. 1) in the "z" direction without compromising the diagnostic imaging quality of x-ray device 100. Assuming, for example, a focal spot 110 motion of 0.25 mm, dimensions "A" and "B" must be at least the same as the sum of the resolving power of the device and focal spot 110 movement. As an example then, for an x-ray device 100 having a focal spot movement of 0.25 mm and a resolution of 2.0 mm, dimensions "A" and "B" must be at least 2.25 mm.

Figure 7:
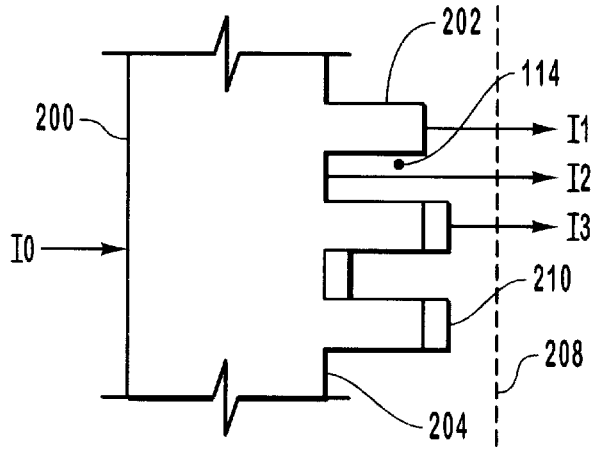
FIG. 7 is a partial section view taken along line B—B of FIG. 4, indicating x-ray intensity at various locations on an embodiment of a window.

With reference now to FIG. 7, another way to facilitate uniform x-ray intensity from window 200 is to employ an attenuator 210 in conjunction with extended surfaces 202 and/or slots 204 such that any differences in the intensity of x-rays emitted through extended surfaces 202 and slots 204 can be minimized.

It is well known that by changing the material of window 200, the intensity of the x-rays emitted therethrough can desirably be varied. That is, different materials absorb different amounts of x-rays. The tendency of a material to absorb x-rays is often referred to in terms of the absorption coefficient of that material, so that a material with a relatively higher absorption coefficient tends to absorb relatively more x-rays than a material having a relatively lower absorption coefficient. In general then, the intensity of x-rays emitted through a material that absorbs a relatively greater amount of x-rays will be relatively lower than the intensity of x-rays emitted through a material that absorbs relatively fewer x-rays.

With continuing reference to FIG. 7, while the intensity I0 of x-rays entering window 200 is typically fairly uniform across window 200, the intensity I1 of x-rays emitted through the end of extended surface 202, as measured at reference plane 208, is different than the intensity I2 of x-rays emitted through slot 204 filled with liquid coolant 304. This difference is due in large part to the fact that liquid coolant 304 absorbs a different amount of x-rays than extended surface 202 does. For example, in the case of a beryllium window 200 in contact with dielectric oil, I1 is greater than I2.

In order to ensure that x-rays exiting window 200 are of a substantially uniform intensity, attenuators 210 are added to the end of extended surfaces 202. In general, the effect of attenuator 210 is to attenuate, or reduce, the intensity of x-rays emitted through extended surface 202 to the point such that intensity I3 is substantially equal to the intensity I2 of x-rays emitted through slot 204 and the liquid coolant 304 disposed therein. In a preferred embodiment, attenuator 210 comprises a material, such as copper, that is readily plated can be securely joined to the ends of extended surfaces 202. As noted elsewhere, extended surfaces 202 preferably comprise beryllium. It will be appreciated however, that parameters including, but not limited to, the thickness and/or material composition of attenuator 210, as well as the material composition of extended surfaces 202, may be varied so as to achieve a desired effect on the intensity of the x-rays emitted through window 200.

Finally, it will further be appreciated that attenuators 210 may be disposed in slot 204, either alone or in combination with attenuators 210 at the ends of extended surfaces 202, so as to achieve a desired effect on the intensity of the x-rays emitted through window 200. For example, this type of arrangement could be effectively employed in situations where extended surfaces 202 have a greater absorption coefficient than the absorption coefficient of the liquid coolant 304 disposed in slots 204. In such situations, the intensity of x-rays passing through liquid coolant 304 must be attenuated so as to substantially match the intensity level of x-rays emitted from extended surfaces 202, and thereby facilitate the uniform x-ray intensity necessary for high quality diagnostic imaging.

As suggested earlier, compensating window 314 (see FIG. 3A) can also serve an attenuation function with respect to x-rays passing through window 200. In particular, because compensating window 314 preferably comprises the same material as window 200, the extended surfaces 314A and slots 314B of compensating window 314 serve to substantially attenuate (in a manner analogous to that described elsewhere herein) any differences in the intensity of x-rays emitted through extended surfaces 202 and through slots 204 of window 200, respectively, so that the intensity of x-rays emitted through compensating window 314 is uniform.

In like fashion, extended surfaces 310B and slots 310C of cooling plenum 310 (see FIG. 3A) serve to substantially attenuate any differences in the intensity of x-rays emitted through extended surfaces 310A and through slots 310D, respectively, so that the intensity of x-rays emitted through cooling plenum 310 is uniform. It will be appreciated that the materials of cooling plenum 310, compensating window 314, window 200, and vacuum enclosure 104 may desirably be varied as required to achieve a desired effect with regard to the intensity of x-rays emitted through cooling plenum 310 and/or compensating window 314.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An x-ray tube, comprising:

(a) a vacuum enclosure having an electron source and a target anode disposed therein, said target anode having a target surface positioned to receive electrons emitted by said electron source; and (b) a window mounted in said vacuum enclosure proximate to at least said target anode so that at least some x-rays produced as a result of said electrons striking said target surface pass through said window, and said window having a plurality of extended surfaces so that a coolant contacting said plurality of extended surfaces absorbs at least some heat dissipated by at least said window.

2. The x-ray tube as recited in claim 1, wherein said vacuum enclosure comprises a plurality of extended surfaces.

3. The x-ray tube as recited in claim 1, further comprising a cooling plenum joined to said vacuum enclosure and having mounted therein a compensating window, said compensating window cooperating with said extended surfaces of said window to define at least one flow passage capable of admitting at least a portion of said coolant so that said coolant absorbs at least some heat dissipated by at least said window.

4. The x-ray tube as recited in claim 1, further comprising a cooling plenum joined to said vacuum enclosure and having mounted therein a compensating window disposed substantially proximate to said window and having an x-ray absorption coefficient value substantially equal to an x-ray absorption coefficient value of said window so that x-rays emitted from said compensating window are of substantially uniform intensity.

5. The x-ray tube as recited in claim 1, wherein said plurality of extended surfaces comprise a plurality of fins.

6. The x-ray tube as recited in claim 1, wherein said plurality of extended surfaces are disposed in a plane substantially parallel to a computerized tomography slice produced by the x-ray tube.

7. The x-ray tube as recited in claim 1, wherein said vacuum enclosure substantially comprises copper.

8. A cooling system for use in conjunction with an x-ray tube and an x-ray tube vacuum enclosure, comprising:

(a) a reservoir containing coolant in which the vacuum enclosure of the x-ray tube is at least partially immersed;

(b) an external cooling unit continuously circulating said coolant through said reservoir; and (b) a window mounted in said vacuum enclosure, said window having a plurality of extended surfaces in contact with said coolant so that said coolant absorbs at least some heat dissipated by at least said window.

9. The cooling system as recited in claim 8, further comprising a cooling plenum joined to said vacuum enclosure and having mounted therein a compensating window, said compensating window cooperating with said extended surfaces of said window to define at least one fluid passageway capable of admitting at least a portion of said coolant so that said coolant absorbs at least some heat dissipated by at least said window.

10. The cooling system as recited in claim 9, wherein at least a portion of coolant exiting said external cooling unit is diverted initially to said fluid passageway.

11. The cooling system as recited in claim 9, further comprising a plurality of extended surfaces disposed on said compensating window, said plurality of extended surfaces disposed on said compensating window cooperating with said extended surfaces of said window to define said fluid passageway.

12. The cooling system as recited in claim 9, further comprising a fluid passageway defined by said cooling plenum, said fluid passageway defined by said cooling plenum being in fluid communication with said fluid passageway cooperatively defined by said compensating window and said extended surfaces of said window.

13. The cooling system as recited in claim 9, wherein said coolant comprises a dielectric oil.

14. A method for cooling an x-ray tube, comprising the steps of:

(a) providing a plurality of extended surfaces in a window of the x-ray tube;

(b) placing a coolant in contact with said plurality of extended surfaces so that said coolant absorbs at least some heat dissipated by said window;

(c) removing at least some heat from said coolant; and (d) repeating steps (b) and (c).

15. The method according to claim 14, wherein said step of placing said coolant in contact with said extended surfaces comprises passing a flow of said coolant into contact with said extended surfaces.

16. The method according to claim 15, further comprising the step of defining a fluid passageway substantially proximate to said extended surfaces of said window, said fluid passageway directing said flow of said coolant into contact with said extended surfaces.

17. The method according to claim 16, wherein said step of removing at least some heat from said coolant occurs after said flow of coolant is discharged from said fluid passageway.

18. The method according to claim 16, further comprising the step of placing at least a portion of said coolant discharged from said flow passageway in contact with the x-ray tube so that said at least a portion of said coolant absorbs at least some heat dissipated by the x-ray tube.

19. A window suitable for use in an x-ray device that includes an x-ray tube in contact with a coolant, the x-ray tube comprising a vacuum enclosure having an electron source and target anode disposed therein, and the target anode having a target surface positioned to receive electrons from the electron source so as to produce x-rays, wherein the window is configured to be mounted in the vacuum enclosure proximate to the target surface so that at least some of the x-rays pass through the window, the window comprising:

(a) a body; and (b) a plurality of extended surfaces attached to said body, at least one of which is arranged for contact with the coolant.

20. The window as recited in claim 19, wherein said plurality of extended surfaces are integral with said body.

21. The window as recited in claim 19, wherein said plurality of extended surfaces comprise a plurality of fins, a slot being interposed between succeeding fins.

22. The window as recited in claim 21, wherein a sum comprising a width of two fins added to a width of two slots is less than a minimum resolving power of the x-ray device.

23. The window as recited in claim 21, wherein a width of each of said plurality of slots is substantially equal to a width of each of said plurality of said fins.

24. The window as recited in claim 21, wherein each of said plurality of fins and said plurality of slots has a width greater than a minimum resolving power of the x-ray device.

25. The window as recited in claim 19, wherein said window comprises beryllium.

26. The window as recited in claim 19, further comprising an attenuator disposed at an end of each extended surface so that x-rays emitted through said window are of substantially uniform intensity.

27. The window as recited in claim 26, wherein said attenuators comprise copper and said window comprises beryllium.

28. The window as recited in claim 19, further comprising an attenuator disposed in a bottom of each slot defined between adjacent extended surfaces so that x-rays emitted through said window are of substantially uniform intensity.

29. The window as recited in claim 19, wherein said extended surfaces are disposed in a plane substantially parallel to a computerized tomography slice produced by the x-ray device.

30. The window as recited in claim 19, further comprising a clear area through which a useful beam portion of x-rays produced by the x-ray device pass.

31. The x-ray tube as recited in claim 1, wherein said window substantially comprises a material selected from the group consisting of: beryllium, titanium, nickel, carbon, silicon, and aluminum.

32. The x-ray tube as recited in claim 1, wherein at least one of said plurality of extended surfaces includes first and second portions, said first portion having a different x-ray absorption coefficient than said second portion.

33. The x-ray device as recited in claim 1, further comprising a cooling plenum joined to said vacuum enclosure and including a compensating window, said compensating window having a plurality of extended surfaces, at least one of which is at least partially received within a corresponding recess defined by said plurality of extended surfaces of said window.

34. The window as recited in claim 19, wherein said window comprises at least first and second portions, said first portion having a different x-ray absorption coefficient than said second portion.

35. The window as recited in claim 34, wherein said first portion comprises a bottom of a slot cooperatively defined by a pair of adjacent extended surfaces, and said second portion comprises a part of at least one of said pair of adjacent extended surfaces.

36. The window as recited in claim 19, wherein said window substantially comprises a material selected from the group consisting of: beryllium, titanium, nickel, carbon, silicon, and aluminum.

37. The window as recited in claim 19, wherein at least one of said plurality of extended surfaces includes first and second portions, said first portion having a different x-ray absorption coefficient than said second portion.

38. An x-ray device, comprising:

(a) a reservoir containing a volume of coolant;

(b) a vacuum enclosure at least partially immersed in said volume of coolant, said vacuum enclosure having an electron source and a target anode disposed therein, said target anode including a target surface positioned to receive electrons emitted by said electron source; and (c) a window mounted in said vacuum enclosure proximate to said target anode, said window including a plurality of extended surfaces, at least one of which is in contact with said coolant.

39. The x-ray device as recited in claim 38, wherein said vacuum enclosure includes a plurality of extended surfaces.

40. The x-ray device as recited in claim 39, wherein at least one of said plurality of extended surfaces of said vacuum enclosure is in contact with said coolant.

41. The x-ray device as recited in claim 38, further comprising a cooling plenum joined to said vacuum enclosure and including a compensating window, said compensating window cooperating with said extended surfaces of said window to define at least one flow passage in fluid communication with said reservoir.

42. The x-ray device as recited in claim 38, further comprising a cooling plenum joined to said vacuum enclosure and including a compensating window disposed proximate to said window, and said compensating window having an x-ray absorption coefficient value substantially equal to an x-ray absorption coefficient value of said window.

43. The x-ray device as recited in claim 38, further comprising a cooling plenum joined to said vacuum enclosure and including a compensating window, said compensating window including a plurality of extended surfaces, at least one of which is at least partially received within a corresponding recess defined by said plurality of extended surfaces of said window.

44. The x-ray device as recited in claim 38, wherein said window includes at least first and second portions, said first portion having a different x-ray absorption coefficient than said second portion.

45. The x-ray device as recited in claim 38, wherein at least one of said plurality of extended surfaces includes first and second portions, said first portion having a different x-ray absorption coefficient than said second portion.

46. A cooling system suitable for use in conjunction with an x-ray device that includes an x-ray tube vacuum enclosure, the cooling system comprising:

(a) a reservoir containing a volume of coolant so that when the vacuum enclosure is received in said reservoir, the vacuum enclosure is at least partially immersed in said coolant;

(b) an external cooling unit in fluid communication with said reservoir; and (c) a window mounted in said vacuum enclosure, said window having a plurality of extended surfaces, at least one of which is in contact with said coolant when the vacuum enclosure is received in said reservoir.

47. The cooling system as recited in claim 46, further comprising a cooling plenum joined to said vacuum enclosure and cooperating with said window to define at least one fluid passageway configured for fluid communication with said external cooling unit.

48. The cooling system as recited in claim 47, wherein at least a portion of said cooling plenum is in contact with said coolant contained in said reservoir when the vacuum enclosure is received in said reservoir.

49. The cooling system as recited in claim 47, wherein said cooling plenum includes a compensating window disposed proximate said window and cooperating with said window to define said at least one fluid passageway.

50. The cooling system as recited in claim 49, wherein said compensating window includes a plurality of extended surfaces, at least one of which is in contact with said coolant.

51. The cooling system as recited in claim 50, wherein at least one of said plurality of extended surfaces of said compensating window is at least partially received within a corresponding recess defined by said plurality of extended surfaces of said window.

* * * * *